United States Patent [19]

Phillips et al.

[11] 4,142,388

[45] Mar. 6, 1979

[54] TUMBLER WHEELS FOR COMBINATION LOCKS

[75] Inventor: Peter J. Phillips, Redondo Beach, Calif.

[73] Assignee: Klaus W. Gartner, La Palma, Calif.

[21] Appl. No.: 782,845

[22] Filed: Mar. 30, 1977

[51] Int. Cl.[2] ..... E05B 37/08

[52] U.S. Cl. ..... 70/316; 70/319

[58] Field of Search ..... 70/316, 317, 318, 319, 70/133, 323, 303 R

[56] References Cited

U.S. PATENT DOCUMENTS

| | | | |
|---|---|---|---|
| 83,129 | 10/1868 | Brettell | 70/319 X |
| 370,568 | 9/1887 | Stoner | 70/316 X |
| 1,145,377 | 7/1915 | Lewis | 70/316 |
| 1,193,754 | 8/1916 | Benham | 70/317 |
| 1,240,114 | 9/1917 | Baum | 70/317 |
| 1,484,692 | 2/1924 | Weber | 70/317 X |
| 1,644,650 | 10/1927 | Millice | 70/316 |
| 1,956,069 | 4/1934 | Hill | 70/316 X |
| 1,956,304 | 4/1934 | Abbott et al. | 70/317 |
| 2,494,575 | 1/1950 | O'Brien | 70/317 X |
| 3,627,938 | 12/1971 | Davidson | 70/317 X |

FOREIGN PATENT DOCUMENTS

| | | | |
|---|---|---|---|
| 1135180 | 12/1968 | United Kingdom | 70/316 |

*Primary Examiner*—Thomas J. Holko
*Attorney, Agent, or Firm*—Poms, Smith, Lande & Glenny

[57] ABSTRACT

The tumbler includes a connection between an outer gate ring and an inner drive member of a tumbler wheel together. The gate ring includes a leg on the gate ring with a gripping portion thereon. The leg normally biases the gripping portion to a securing position against the drive member to grip it so that the gate ring and drive member normally rotate together. An opening is provided in the gate ring adjacent the leg having a curved portion about its periphery for receiving a key having a curved portion about its periphery. The key rotates against the curved surface of the opening, and a cam section of the key cams a cam follower portion of the leg when the key is rotated to a releasing position for urging the gripping portion away from the drive member. The camming surface, opening and cam follower are so provided that on rotation of the key in the opening to the releasing position, the biasing effect of the leg is prevented from tending to return the key to the securing position. An aperture through the case is aligned with the openings in the gate rings when the arm is in each gate for passage of the key therethrough. The key has a cut-out portion which is located in the aperture when the key is in all the openings. the aperture has a shape that cooperates with the cut-out portion of the key to limit rotation of the key to the releasing position and to prevent the portion of the key in the case beyond the cut-out portion from being removed from the case except when the key is in the inserting position.

4 Claims, 10 Drawing Figures

TUMBLER WHEELS FOR COMBINATION LOCKS

BACKGROUND OF THE INVENTION

This invention relates generally to combination locks and more particularly, it relates to a system for changing the combination of such locks.

Most prior art combination locks rely on having tumbler wheels with gates thereon. When the proper combination is dialed, an arm fits into the gates. Depending on the construction of the lock, when the arm falls into the gates, the latch can be released, or when the arm falls into the gates, it can abut a pawl connected to the dial whereby further rotation of the dial pulls the arm to open the latch.

In such locks, the tumbler wheels are normally two pieces, an inner drive member and an outer gate ring. Means are provided for connecting the two parts of the tumbler wheel together. The position of the gate rings when they are aligned is always the same for each lock, no matter what the chosen combination is. Different combinations are obtained by changing the orientation of each drive member in the gate ring because the drive members are fixed to the combination dial.

Many combination locks have a mechanism for releasing the gate ring from the drive member to change the combination of the lock. In order to accomplish this, however, many tumbler wheels are relatively complex. For example, Murphy, U.S. Pat. No. 901,116 (1908) is somewhat typical of common tumbler wheels. The outer gate ring is a hollow casting surrounding a toothed drive member. A spring arm is inserted in the hollow casting and teeth on the arm engage the teeth on the inner drive member. A camming member is also inserted in the hollow casting, and by rotating the cam, the arm is urged away from or against the inner drive member. Because of their complexity, such tumbler wheels are relatively expensive to manufacture. Parts on the gate ring must be machined to relatively tight tolerances so that they will properly fit together. Moreover, parts must be assembled within the gate ring. One object of the present invention is to provide a lower cost gate ring to eliminate the necessity of the machining and assembly steps of the prior art.

One-piece gate rings have been proposed. For example, the gate ring in Brettell, U.S. Pat. No. 145,618 is made of elastic material that urges itself against the drive ring. The gate is formed where the ring is split at its ends. The device eliminates some of the problems associated with machined gate rings. However, it and the machined gate rings suffer from another problem. In order to change combinations, the gate ring must be released from the drive member. When the gates are aligned, a corresponding portion of each gate ring is aligned with an opening through the case. A key or tool is inserted through the opening to engage a cam or otherwise to open the gate ring. In devices such as Murphy, the key is inserted into a cam, and turning the cam allows the arm on the gate ring to move out of engagement with the drive member thereby releasing it. Rotating the cam back to its original position urges the arm into engagement with the drive member. In the Brettell reference, a tool is inserted between opposing portions of the gate ring, and when turned, it overcomes the resiliency of the gate ring to release it from the drive member. However, the resiliency of the gate ring tends to urge the key back to its initial position permitting the gate ring to engage the drive member and preventing adjustment of the combination. Therefore, it is an object of the present invention to overcome the problem by eliminating extra cams and by designing the gate ring release in such a manner that the resilient arm will not urge the arm back to its gripping position when the key is rotated to the arm release position.

Another problem associated with changeable combination locks is removal of the key from the back of the case while the gate rings on any of the tumblers are released from their associated drive rings. If this occurs, it would be possible to have a drive member that could slip in its connection with the gate ring. That occurrence would misalign the gate ring with the dial, and it would be impossible to again align the gates thereby aligning the cams or gate ring opening so that the gate ring could be secured to the drive member. Thus, the lock would be rendered useless.

Therefore, it is another object of the present invention to disclose and provide a combination lock permitting removal of the key only when the gate ring is secured to the drive member. Of course, it is an object of the present invention to construct a combination lock which is both reliable and low cost and which eliminates problems occurring in the prior art. These objects are met by the present invention which also meets other objects that, although not set forth specifically herein, are evident from the description of the invention.

SUMMARY OF THE INVENTION

In a system for releasing the connection between a gate ring and a drive member of a tumbler wheel, a leg on the gate ring has gripping means thereon biased against the drive member for grippng the drive member. An opening is provided in the gate ring adjacent the gripping means for receiving a release key therein to position the key adjacent the leg. The key has a cam section that is inserted into the opening and is rotated in the opening to a releasing position against the surface of the opening. The key has a camming surface presented toward the cam follower, and rotating the key cams a cam follower on the leg to cause the gripping means to release the drive member. The resultant line of force due to bias of the leg against the key is perpendicular to the tangent at the point of intersection between the line of force and the surface of the opening. The camming surface, opening and cam follower are so provided that on rotation of the key in the opening to a releasing position, wherein the gripping means is disengaged from the drive member, the biasing effect of the leg is prevented from tending to return the key to a locked position.

The case is provided with an aperture means therethrough aligned with the opening in the gate ring when the gates are aligned and the latch arm is in each gate. The key passes through the aperture. The key has a cut-out portion which is located in the aperture when the key is in all the openings. The aperture has means cooperating with the cut-out portion of the key to limit rotation of the key to the releasing position and to prevent the portion of the key in the case beyond the cut-out portion from being removed from the case except when the key is in the inserting position.

DETAILED DESCRIPTION OF THE PREFERRED EMBODIMENT

The Lock Mechanisms

Figure 1:
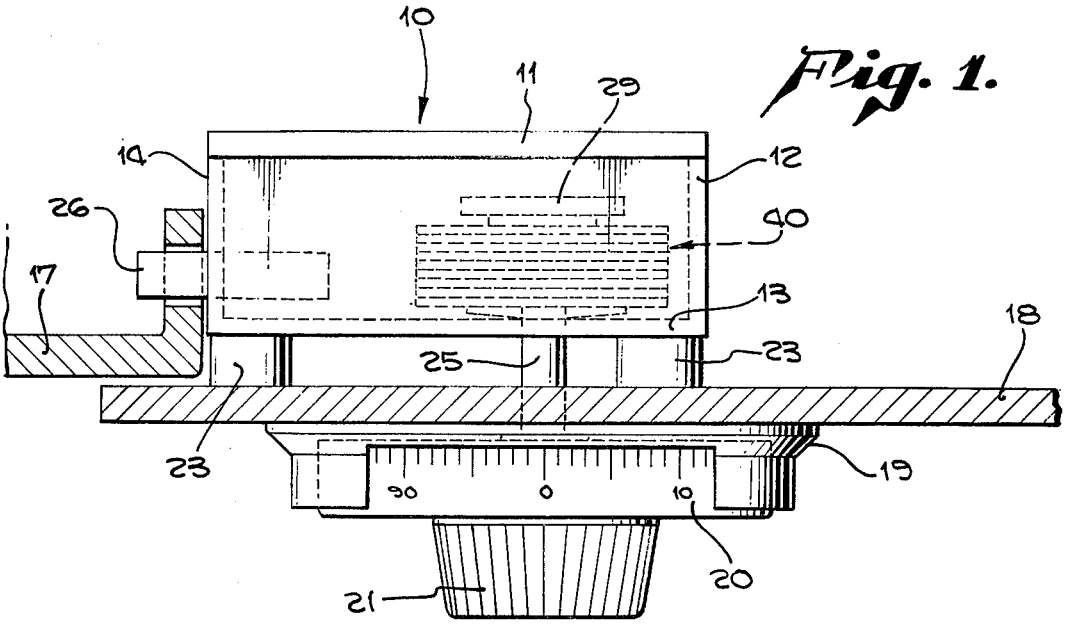
FIG. 1 shows a plan view, partially in section of the combination lock of the present invention.
Figure 2:
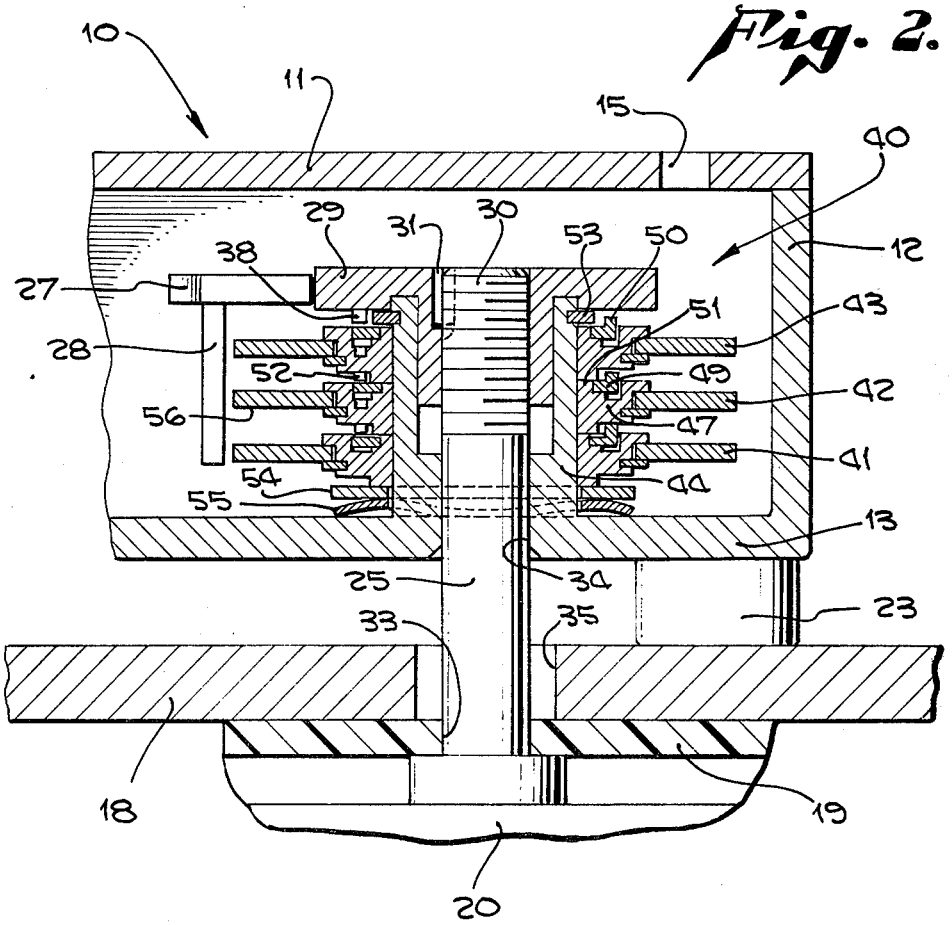
FIG. 2 is also a plan view in section showing more detail of the tumblers and their connection to the dial.

The combination lock of the present invention includes a case 10 with a plurality of tumblers 40 inside the case. Case 10 includes front wall 13, rear wall 11 and sidewalls 12 and 14. Top and bottom walls (not shown) are also provided. Case 10 is secured to door 18 and is spaced slightly apart therefrom by spacers 23 (FIGS. 1 and 2).

Dial 20 is mounted in dial housing 19, the latter being secured to door 18. Shaft 25 is secured at one end to dial 20 and at its other end to driver 29. Shaft 25 is threaded at 30 into driver 29 and is keyed at 31 to prevent rotation of driver 29 on shaft 25.

Shaft 25 is journaled at 33 in dial housing 19 and is journaled through bore 34 and journal housing 44 in front wall 13 of case 10. An aperture 35 is provided in door 18 to allow passage of the shaft from dial 20 to driver 29. The plurality of tumblers 40 are driven by driver 29 in a manner set forth below.

Figure 3:
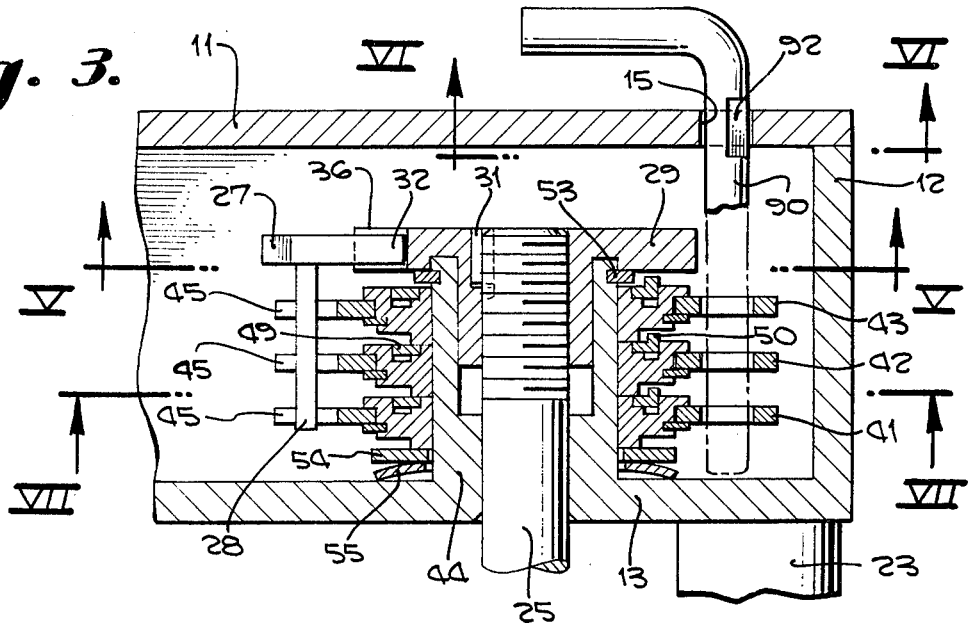
FIG. 3 is a view of the combination lock of the present invention similar to that in FIG. 2 but showing the manner in which the key may be inserted into the openings in the gate rings.
Figure 7:
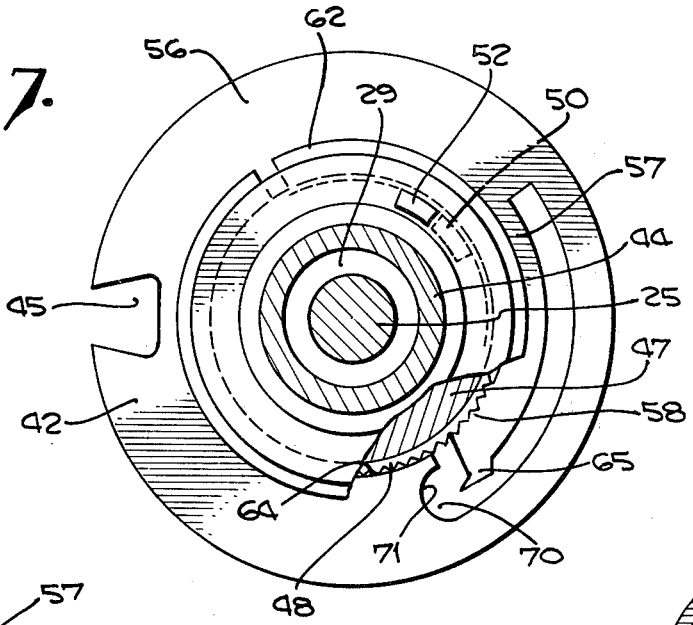
FIG. 7 is a sectional view taken through plane VII—VII of FIG. 3, and shows the detail of one of the tumblers of the present invention.

Each tumbler 41, 42 and 43 has a gate 45 (FIGS. 3 and 7). Projection 28 on latch arm 27 extends across all three tumblers. When the proper combination is dialed, the gates 45 on all three tumblers become aligned below projection 28. Projection 28 can then fall into gates 45 which permits hook 32 on latch arm 27 to engage hook 36 on driver 29. When this occurs, continued rotation of driver 29 pulls latch arm 27 to the right (FIG. 3), and through the connection between latch 27 and latch 26, urges latch 26 to the right (FIG. 1). When the latch 26 is withdrawn inside case 10, door 18 can be pivoted away from safe wall 17 for access into the safe.

In another embodiment (not shown) the latch is withdrawn into the case by a separate bolt which is prevented from moving the latch by latch arm 27 until projection 28 is received within gates 45.

The Tumblers

The construction and operation of the tumblers is discussed herein. Each tumbler 41, 42 and 43 includes an inner drive member 47 (FIGS. 7 and 10) which are mounted for rotation about journal housing 44 with shaft 25 journaled at 34 in journal housing 44.

Figure 4:
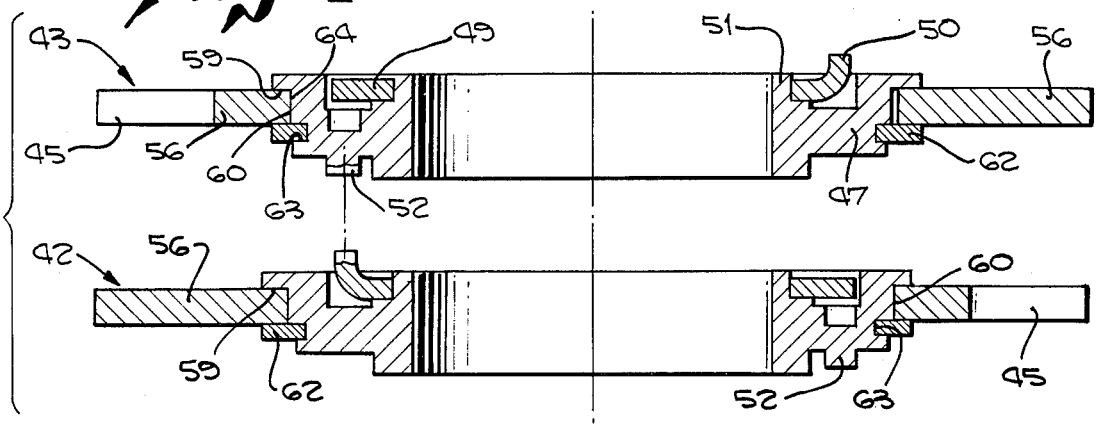
FIG. 4 is a plan view in section of two of the adjacent tumbler wheels of the present invention.
Figure 8:
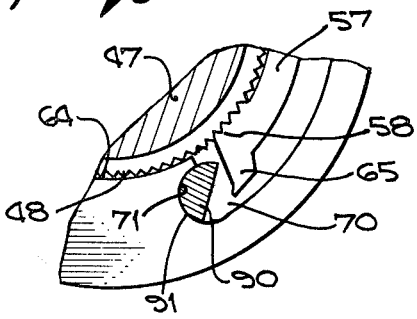
FIGS. 8 and 9 are details about the opening through the gate ring and show the securing position (FIG. 8) and the releasing position (FIG. 9) of the key and gate ring.

Each drive member 47 includes nub ring 49 having nub 50 projecting therefrom (FIGS. 4 and 8). Nub ring 49 is press fit onto rim 51 of drive member 47.

Nub 50 is positioned on drive member 47 in such a manner that it is connected by projection 38 on driver 29 when the driver is rotated. During either counterclockwise or clockwise rotation of driver 29, when the projection 38 intersects nub 50, it will cause drive member 47 of tumbler 43 to rotate in the same direction.

Likewise, each drive member 47 has its own projection 52 extending in an opposite direction from nub 50. As driver 29 is rotated sufficiently to rotate drive member 47 on tumbler 43, projection 52 on drive member 47 of tumbler 43 will engage nut 50 on tumbler 42. Likewise, the projection 52 on tumbler 42 engages nub 50 on tumbler 41. By correctly dialing the combination, the tumblers are rotated until all of the gates 45 are aligned (FIG. 3).

The tumblers are held in their axial location on journal housing 44 by bushing 53, washer 54 and spring washer 55.

Figure 10:
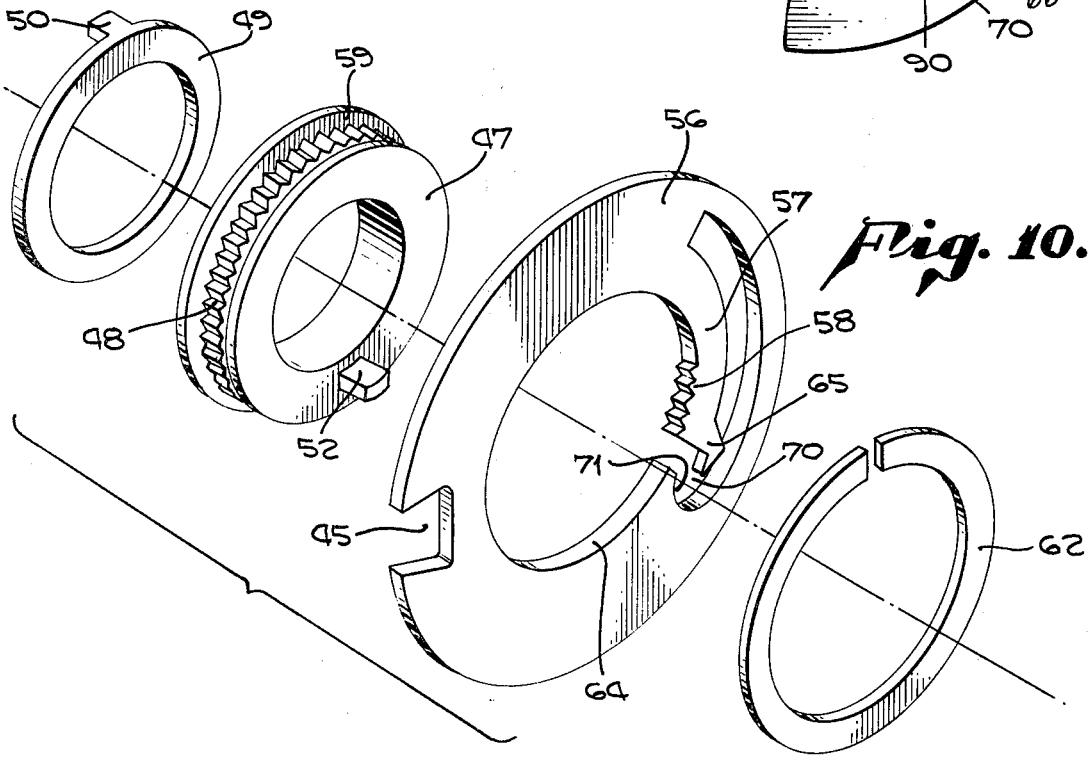
FIG. 10 is an exploded view of the components of the tumbler wheel of the present invention.

Surrounding each drive member is a gate ring 56 (FIGS. 4, 7 and 8). Gate ring 56 abuts shoulder 59 and rim 60 of drive member 47 and is held in place by snap ring 62 (FIGS. 4 and 10). As shown in FIG. 4, snap ring 62 fits against shoulder 63 to secure gate ring 56 in place.

A leg is provided and gripping means on each leg extends toward the drive member for gripping the drive member. In the exemplary embodiment, especially as shown in FIGS. 7–10, leg 57 is integral with gate ring 56. The gripping means comprises a toothed edge 58 at the end of leg 57 which extends toward drive member 47 for gripping it. The drive member is provided with teeth 48 around its periphery for being gripped by teeth 58 on the gripping means.

Leg 57 is biased to urge gripping means 58 against teeth 48 of drive member 47 so that drive member 47 is normally secured to gate ring 56. When the gate ring and inner drive member are together, the inner bore 64 of gate ring 56 rests on teeth 48 and would normally be free to rotate thereabout. However, teeth 58 engage teeth 48 to prevent rotation of the gate ring on teeth 48 of drive member 47.

An opening is provided in each gate ring adjacent the leg. As shown in FIGS. 7 through 10 of the preferred exemplary embodiment, opening 70 is provided in the gate ring adjacent gripping means 58. The gripping means terminates in a cam follower portion 65, extending at the end of the leg. The function of the cam follower portion will be described hereinafter.

Opening means 70 includes a curved portion about at least part of its periphery. As best shown in FIG. 7 of the exemplary embodiment, curved portion 71 is on the opposite side of opening 70 from gripping means 58. Opening 70 receives a release key or tool 90 (FIG. 3) also having a curved portion 91 (FIG. 6) about at least a portion of its periphery. In the preferred exemplary embodiment, key 90 has somewhat of a semicircular cross section which fits through opening 15 in rear wall 11 of case 10. Opening 15 has a cross section similar to that of key 90, and aperture 15 is aligned with opening means 70 of all gate rings when gates 45 are aligned and receiving projection 28 on latch arm 27. A cut-out 92 is provided in key 90 for a function set forth hereinafter.

Figure 9:
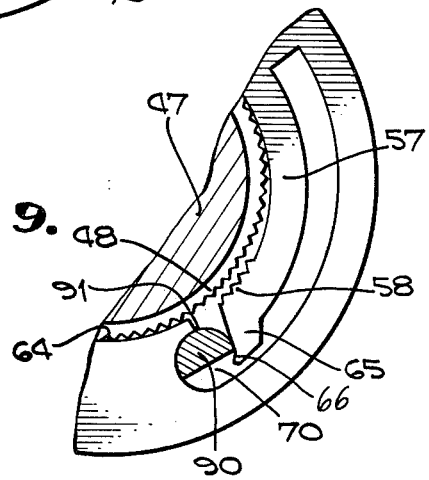

Camming means are provided for camming key 90 against curved surface 71 of the opening means 70 on rotation of the key in the opening and reacting thereto against the bias of the leg to move the leg to remove to a releasing position the gripping means away from the drive member. In the preferred exemplary embodiment, especially in FIGS. 8 and 9, camming means includes cam follower 65 at the end of leg 57 which cams key 90 against curved surface 71 when the key is rotated to a releasing position in the opening (FIG. 9). The curved portion 71 on the opening means and camming means 65 on leg 57 are provided such that when the key is in the releasing position (FIG. 9), the leg does not rotate the key away from the releasing position. In the exemplary embodiment, because of the designs of the curved surface, once key 70 is rotated to the releasing position of FIG. 9, its curved surface 91 cooperates with curved surface 71 and camming means 65 under urging from the resiliency of leg 57 to hold key 70 in the releasing position of FIG. 9. Thereafter, a new combination can be dialed into the lock without having to hold key 70 in its releasing position.

Surface 71 of the opening means against which key 90 rotates at the releasing position has a tangent at the intersection of the resultant line of force due to bias of the leg against the key which is perpendicular to the line of force so that force from the bias of the leg tends to hold the key in the releasing position. Essentially, in the exemplary embodiment, opening 70, key 90 and angled extension 66 are so designed that when the key is in the releasing position of FIG. 9, the resultant force from the bias of leg 57 through cam follower 65 acting on key 70 tends to urge the key in a direction from the inserting position to the releasing position which is clockwise in FIG. 9. Surfaces 91 and 71 have a generally coincident axis of rotation as key 90 rotates along surface 71. If the resultant force from camming means 65 and angled extension 66 is to the right or below the axis of rotation of key 90 (FIG. 9), the force on the key will be in a clockwise direction. It can also be said that the orientation is an over-center one. When the leg is desired to be released, it is ideal that the key be in the over-center orientation.

The Cut-Out Portion of the Key

Figure 6:
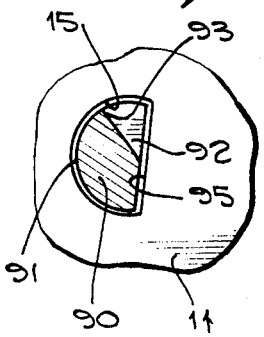
FIG. 6 is a sectional view taken through plane VI—VI of FIG. 3, and shows the detail of the aperture with the cut-out section of the key therein.
Figure 5:
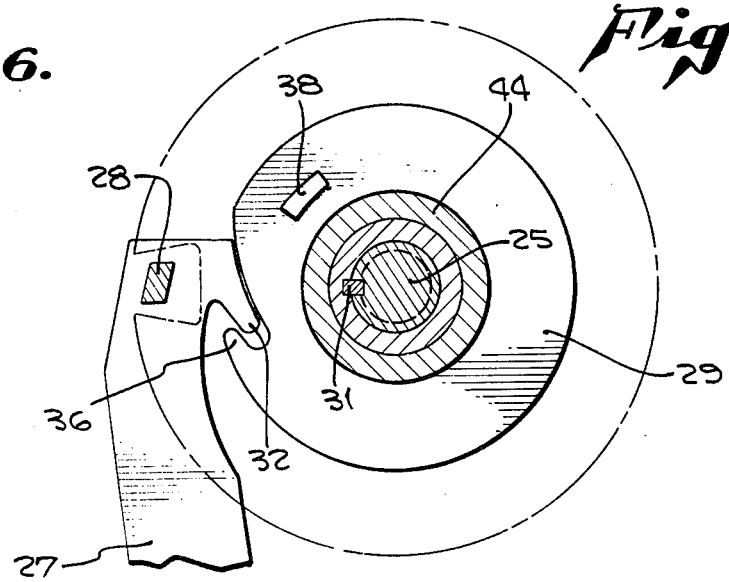
FIG. 5 is a sectional view taken through the plane V—V in FIG. 3, and shows in detail the connection between the latch arm and the opening pawl.

Key 90 has a cut-out portion 92 (FIG. 6). Because of the respective shapes of aperture 15 and key 90, the key can only be inserted into the aperture in one orientation, and once inserted, it cannot be rotated until cut-out portion 92 is located within the confines of aperture 15 (FIGS. 3 and 6). Cut-out 92 is so positioned on key 90 that it only coincides with aperture 15 when key 90 is in all of the openings 70 of gate rings 56. Therefore, no turning of the key can take place until the key is in all of the openings.

The aperture cooperates with the cut-out portion of the key to limit rotation of the key to the releasing position. As shown in FIG. 6 in the exemplary embodiment, key 90 can rotate clockwise approximately 30° until face 93 of the cut-out portion intersects face 95 of aperture 15. The angle that face 93 makes with face 95 is just sufficient to allow key 90 to reach its over-center orientation of FIG. 9.

When the key is in the over-center position with face 93 of the cut-out portion against face 95 of the aperture, the portion of the key that does not include cut-out 92 will not be in the correct orientation to move through aperture 15. Therefore, key 90 cannot be removed from case 10 except when the key is in the inserting position. This is a desirable feature because it prevents the key from being removed from the tumblers when the gripping means is in the releasing position. If that occurred, movement of the dial would disorient the gate rings in an unpredictable manner. Thereafter, one could not again use the combination lock because he could not again align the gates.

It will be understood that various modifications and changes may be made in the configuration described above which may come within the spirit of this invention, and all such changes and modifications coming within the scope of the appended claims are embraced thereby.

We claim:

1. In a system for connecting a gate ring and a drive member of a tumbler wheel together wherein the gate ring includes a single leg unitarily formed from the gate ring with gripping means thereon, the leg normally biasing the gripping means against the drive member whereby the gripping means grips the drive member so that the gate ring and the drive member normally rotate together, the improvement comprising:

opening means in the gate ring adjacent the leg and having a curved portion about at least part of its periphery for receiving a key having a curved portion about at least a portion of its periphery, camming means on the leg opposite the opening means in the plane of the gate ring for camming the key against the curved surface of the opening on rotation of the key in the opening to a releasing position and reacting thereto against the bias of the leg to move the leg to remove the gripping means away from the drive member, the curved portions on the opening means and the camming means on the leg being provided so that when the key is in the releasing position the leg does not rotate the key away from the releasing position.

2. In a combination lock including a case, each tumbler having a gate therein, a latch movable between a latching position extending generally out of the case and an unlatching position generally within the case, a latch arm movable into the gates when all the gates on the plurality of tumblers are aligned, means interconnecting the latch arm with the latch for preventing movement of the latch when the arm is not received within the gates, a shaft mounted for rotation in the case, the tumblers being mounted about the shaft for rotation with respect to the shaft, each tumbler including a drive member about the shaft and a gate ring mounted on the drive member, a single leg unitarily formed from each gate ring, gripping means on each leg extending toward the drive member for gripping the drive member, each leg being formed such that it is normally urging the gripping means against the drive member so that the drive member is secured to the gate ring, the improvement comprising:

an opening in each gate ring adjacent the gripping means, a key for insertion into the opening and being rotatable in the opening from an inserting position to a release position against the surface of the opening for camming the gripping means to release the drive member by urging the leg from its normal position against bias from the leg, the surface of the opening against which the key rotates being opposite the gripping means in the plane of the gate ring and being curved, and the key having a curved cross section rotating on the curved surface, the cross section of the key conforming generally to the curvature of the surface around the area where the key and the curved surface intersect when the key is in the release position.

3. The improvement of claim 2 further comprising a rim on the drive member for receiving the gate ring therearound, a shoulder on the drive member for preventing axial movement of the gate ring in one direction on the drive member, a snap ring and means for receiving the snap ring on the drive member for holding the gate ring against the shoulder.

4. The improvement of claim 3 further comprising a nub ring having a nub thereon and means for mounting the nub ring on the drive member for projecting the nub in one direction from the drive member and projection means on the opposite side of the drive member projecting the opposite direction of the nub, the nub and projection intersecting a projection and a nub respectively on adjacent drive members for rotating the drive members.

* * * * *

UNITED STATES PATENT AND TRADEMARK OFFICE

CERTIFICATE OF CORRECTION

PATENT NO. : 4,142,388

DATED : March 6, 1979

INVENTOR(S) : Peter J. Phillips

It is certified that error appears in the above-identified patent and that said Letters Patent are hereby corrected as shown below:

Delete claims 3 and 4.

On the title page after the "Abstract", "4 Claims" should read -- 2 Claims --.

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*